US006276910B1

(12) United States Patent
Tsukamoto

(10) Patent No.: US 6,276,910 B1
(45) Date of Patent: Aug. 21, 2001

(54) SCROLL-TYPE COMPRESSOR HAVING AN OIL GROOVE INTERSECTING THE SUCTION PORT

(75) Inventor: Ko Tsukamoto, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/460,646

(22) Filed: Dec. 14, 1999

(30) Foreign Application Priority Data

Dec. 14, 1998 (JP) ..... 10-354509

(51) Int. Cl.[7] ..... F04C 18/04; F04C 29/02
(52) U.S. Cl. ..... 418/55.6; 418/100
(58) Field of Search ..... 418/55.6, 99, 100

(56) References Cited

U.S. PATENT DOCUMENTS 4,547,138 * 10/1985 Mabe et al. ..... 418/55.6
4,561,832 * 12/1985 Shimizu ..... 418/55.6
5,076,771 * 12/1991 Ban et al. ..... 418/55.6
5,713,731 * 2/1998 Utter et al. ..... 418/55.6

* cited by examiner

*Primary Examiner*—John J. Vrablik
(74) *Attorney, Agent, or Firm*—Baker Botts L.L.P.

(57) ABSTRACT

A scroll-type compressor includes a housing having a suction chamber with a suction port provided on a wall of the housing that opens into the suction chamber. The compressor also includes first and second scroll members at an angular and radial offset for forming fluid pockets, each scroll member having a spiral element. A groove is formed on an inner surface of the housing and an outer peripheral surface of one of the spiral elements. The groove extends in a circumferential direction of the housing at a position to include the suction port and forms an oil path for introducing oil into the interior of the housing when the compressor is assembled. Because the oil path is formed regardless of the position of the scroll member, oil may be introduced into the interior of the housing through the suction port without generating an overflow of oil to the outside of the housing.

6 Claims, 3 Drawing Sheets

SCROLL-TYPE COMPRESSOR HAVING AN OIL GROOVE INTERSECTING THE SUCTION PORT

BACKGROUND OF THE INVENTION

1. Field of the Invention

The present invention relates to a scroll-type compressor, and, more specifically, to a scroll-type compressor in which oil is introduced from a suction port into the interior of a housing when the compressor is assembled.

2. Description of Related Art

A scroll-type compressor is a fluid displacement apparatus wherein a pair of spiral elements are engaged to each other at an angular and radial offset. Orbital movement between the pair of spiral elements creates fluid pockets that are moved inwardly and change in volume to compress a fluid sucked from a suction chamber to the fluid pockets. The compressed fluid is discharged from the fluid pockets to a discharge chamber.

For example, as depicted in FIG. 3, a known scroll-type compressor has a housing 10. Housing 10 includes a rear housing 101 and a front housing 100. Front housing 100 includes a large-diameter cylindrical portion 103 fixed to an open end of rear housing 101, and a small-diameter cylindrical portion 105. Rear housing 101 and front housing 100 are aligned coaxially.

Drive shaft 11 is provided on a center axis X of housing 10. Drive shaft 11 extends to the interior of housing 10 through small-diameter cylindrical portion 105 of front housing 100. Drive shaft 11 includes a small-diameter portion 11*a* surrounded by small-diameter cylindrical portion 105 of front housing 100, and a large-diameter portion 11*b* surrounded by large-diameter cylindrical portion 103 of front housing 100. Drive pin 12 is fixed to the end of large-diameter portion 11*b*. Drive pin 12 extends in parallel to axis X and at a position eccentric from axis X. Large-diameter portion 11*b* is rotatably supported in cylindrical portion 103 via needle bearing 13. Small-diameter portion 11*a* is rotatably supported in cylindrical portion 105 via ball bearing 14.

An electromagnetic clutch 15 is supported on the outer surface of small-diameter cylindrical portion 105, and rotates via bearing 15*d*. Electromagnetic clutch 15 has a pulley 15*a* that is connected to an external drive source (not shown) by a V-type belt (not shown), and a rotation transmitting plate 15*c* that is fixed to the end of small-diameter portion 11*a*. Drive shaft 11 is driven by the external drive source via the clutch mechanism.

A first scroll member 16, known as a fixed scroll member, and a second scroll member 20, known as an orbital scroll member, are disposed within rear housing 101. First scroll member 16 has a disc-like first end plate 16*a* that is disposed coaxially along axis X and fitted into rear housing 101, and a first spiral element 16*b* that axially extends into an interior of rear housing 101 a surface of first end plate 16*a*. A leg portion 16*c* is formed an opposite surface of first end plate 16*a*. The top surface of leg portion 16*c* is in contact with the inner surface of bottom portion 101*a*. First scroll member 16 is fixed to rear housing 101 by bolt 17 inserted into leg portion 16*c* through bottom portion 101*a*. The interior of rear housing 101 is partitioned into a suction chamber 18 and a discharge chamber 19 by first end plate 16*a* of first scroll member 16.

Second scroll member 20 is disposed adjacent to first scroll member 16 in rear housing 101. Second scroll member 20 has a disc-like second end plate 20*a* disposed along axis Y that is radially offset from axis x by an amount of rs, and a second spiral element 20*b* that axially extends into the interior of rear housing 101 on a surface of second end plate 20*a*. Further, second scroll member 20 has a ring-shaped boss 20*c* formed on an opposite surface of second end plate 20*a*. Axis Y of second end plate 20*a* is positioned eccentric from axis X by an amount of rs. Second spiral element 20*b* of second scroll member 20 engages first spiral element 16*b* of first scroll member 16 at an angular offset of 180 degrees.

A suction port 18*a* that communicates with suction chamber 18, and a discharge port 19*a* that communicates with discharge chamber 19 are provided within rear housing 101. Referring to FIG. 3, suction port 18*a* opens foward second spiral element 20*b*of second scroll member 20. Although second scroll member 20 moves according to an orbital motion, as depicted in FIG. 3, second spiral element 20*b* is located at a position near suction port 18*a*, such that suction port 18*a* is almost closed by the outer surface of second spiral element 20*b*. Such an alignment may be employed in a compressor for an air conditioner for vehicles so that the compressor size is reduced. Typically, oil is introduced initially into suction chamber 18 through suction port 18*a* and enclosed in housing 100 when the compressor is assembled.

An eccentric bush 21 is disposed rotatably in boss 20*c* via needle bearing 22. Eccentric bush 21 is formed as a cylindrical body having a relatively large thickness, and disposed coaxially with second end plate 20*a*. An eccentric through hole 21*a* extends in parallel to axis X, and is defined in eccentric bush 21. A counter weight 23 is fixed to eccentric bush 21. Counter weight 23 extends in the radial direction of eccentric bush 21. Drive pin 12 is fixed to the end of large-diameter portion 11*b* of drive shaft 11, and is inserted slidably into through hole 21*a* of eccentric bush 21. Pin 21*b* is fixed to eccentric bush 21 and connects eccentric bush 21 and counter weight 23.

A race 24 is formed as a ring plate, and is fixed to the end surface of large-diameter cylindrical portion 103 of front housing 100. A race 25 is formed as a ring plate and is positioned to face race 24. Race 25 is fixed to the side surface of second end plate 20*a* of second scroll member 20. A plurality of balls 26 are interposed between races 24 and 25. Races 24 and 25, and balls 26 form a ball coupling mechanism for preventing rotation of second scroll member 20 while allowing revolution of second scroll member 20.

In such a scroll-type compressor, balls 26 roll along a circular route as defined between races 24 and 25 that has about the same radius as the radius of revolution rs of second scroll member 20. Balls 26 may roll while being pressed against races 24 and 25. Consequently, second scroll member 20 revolves while maintaining a predetermined angular relationship relative to front housing 100 and relative to first scroll member 16.

When the scroll-type compressor initially is assembled, oil is introduced into suction chamber 18 through suction port 18*a*. However, if oil is introduced into suction chamber 18 when second spiral element 20*b* of second scroll member 20 is located at a position near suction port 18*a*, such that suction port 18*a* is about closed by the outer surface of second spiral element 20*b*, then oil may overflow from suction port 18*a* to the outside of the compressor. This overflow may occur because the oil does not completely enter into suction chamber 18 through suction port 18*a*. In particular, when oil is introduced at an increased flow rate, oil may overflow from suction port 18*a* to the outside of the compressor. In order to avoid overflows, oil is introduced into suction chamber 18 after the position of second spiral element 20*b* of second scroll member 20 is shifted away from suction port 18*a* by hand rotating drive shaft 11. Such a procedure consumes time, thereby reducing the productivity of the compressor assembling operations.

SUMMARY OF THE INVENTION

Accordingly, it is an object of the present invention to provide an improved structure for a scroll-type compressor that allows the introduction of oil at an increased flow rate regardless the position of a scroll member when the compressor is assembled, thereby increasing the productivity of the compressor assembling operations.

To achieve the foregoing and other objects, a scroll-type compressor according to the present invention is provided. The scroll-type compressor includes a housing having a suction chamber and a discharge chamber, and a suction port provided on a wall of the housing that opens into the suction chamber. The compressor also includes a first scroll member disposed within the housing and having a first end plate from which a first spiral element axially extends into an interior of the housing. The compressor also includes a second scroll member disposed for nonrotatable, orbital movement relative to the first scroll member within the interior of the housing and having a second end plate from which a second spiral element axially extends into the interior of the housing. The first and second spiral elements interfit at an angular and radial offset to make a plurality of line contacts that define at least one pair of sealed off fluid pockets. The compressor also includes a drive mechanism operatively connected to at least one of the first and second scroll members to cause relative orbital movement between the first and second scroll members and the line contacts such that the fluid pockets move inwardly and change in volume. Thus, a fluid is sucked from the suction chamber to the fluid pockets and a compressed fluid is discharged from the fluid pockets to the discharge chamber.

The scroll-type compressor comprises a groove formed on at least one of an inner surface of the housing and an outer peripheral surface of one of the first and second spiral elements. The groove extends in a circumferential direction of the housing at a position adjacent the suction port to form an oil path for introducing oil into the interior of the housing.

In the scroll-type compressor, the groove may extend along the entire circumference of the housing. Further, a padding portion may be formed on an outer surface of the housing at a position corresponding to the groove.

In the scroll-type compressor according to the present invention, the groove is defined when the housing or the spiral element, or both, are processed. Because the groove extends in a circumferential direction of the housing at a position adjacent the suction port, an oil path may be formed to communicate from the suction port to the interior of the suction chamber, regardless of the position of the spiral element as the compressor is assembled. Consequently, oil may be introduced into the suction chamber through the suction port regardless of the position of the spiral element, and without causing the overflow of oil from the suction port to the outside of the housing. Therefore, even if the spiral element is located at a position near the suction chamber, the oil introduction route may be formed by the groove, and oil may be introduced into the suction chamber.

Further, because the inner peripheral surface of the housing is processed by turning, i.e., cutting by machining, the groove extending over the entire circumference of the inner peripheral surface may be defined in a simple manner. Moreover, if a padding portion is formed on the outer surface of the housing at a position corresponding to the groove, and preferably using the same material as that of the housing, the local strength of the housing may be reinforced.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
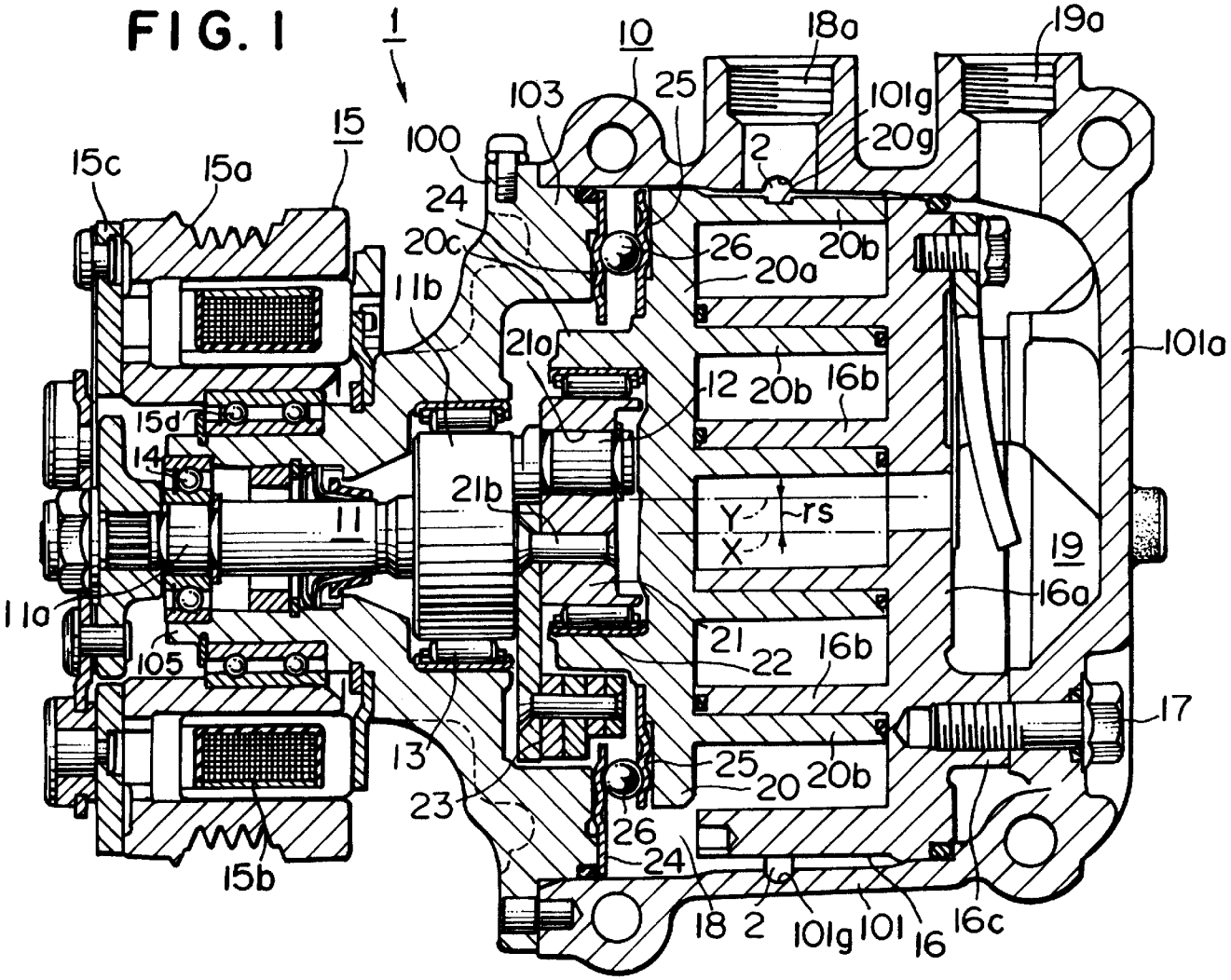
FIG. 1 is a vertical, cross--sectional view of a scroll-type compressor according to an embodiment of the present invention.
Figure 3:
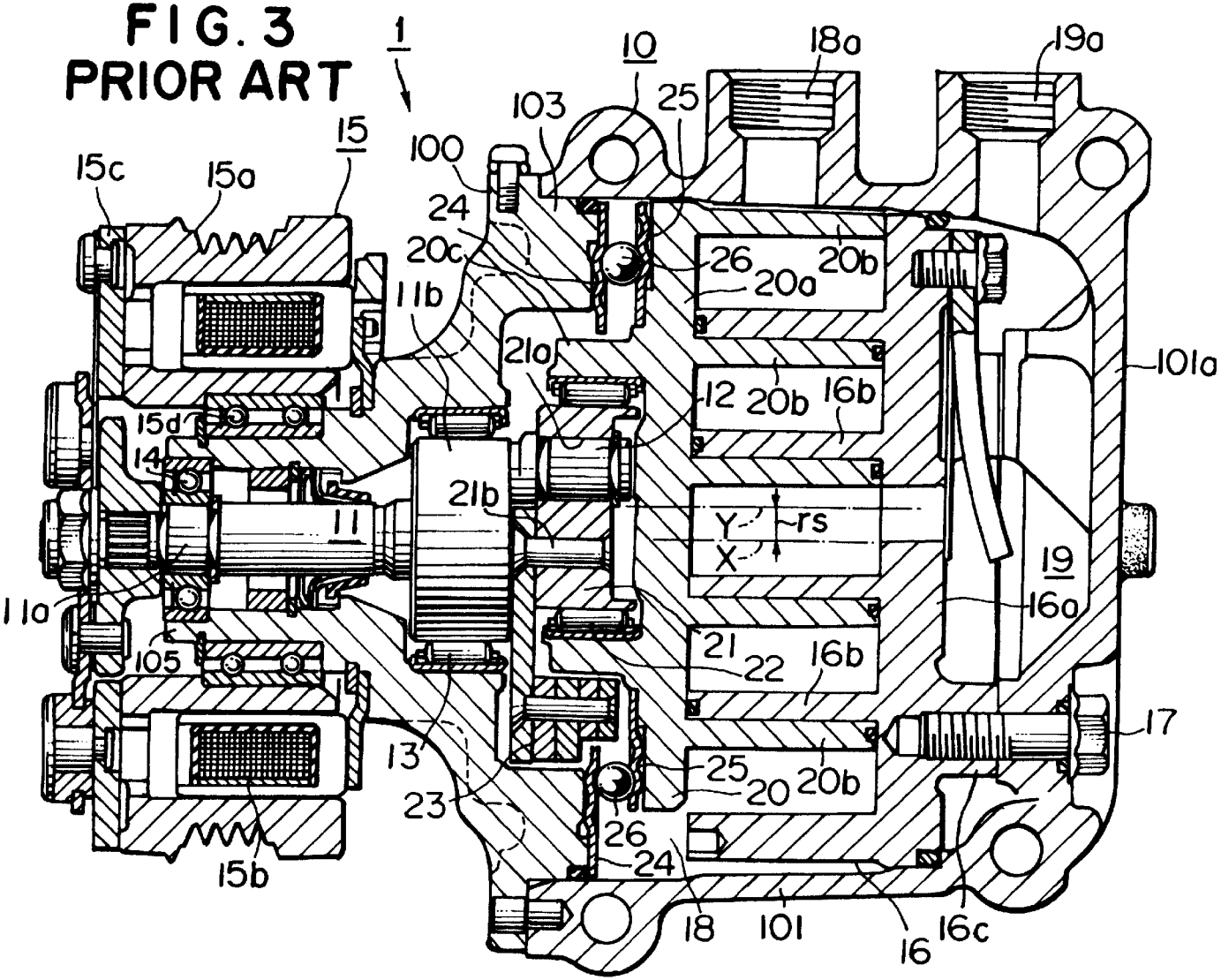
FIG. 3 PRIOR ART
FIG. 3 is a vertical, cross-sectional view of a known scroll-type compressor.

Referring to FIG. 1, a scroll-type compressor according to an embodiment of the present invention is provided. In FIG. 1, scroll-type compressor 1 has a substantially similar structure as that of the known scroll-type compressor depicted in FIG. 3, except for an oil path 2 and the other features described below. Therefore, with respect to those features of scroll-type compressor 1 similar to those of the scroll-type compressor depicted in FIG. 3, the explanation of those features are omitted and given the same numeral designations as those in FIG. 3.

In this embodiment, second spiral element 20*b* of second scroll member 20 is disposed so that the outer peripheral surface of second spiral element 20*b* faces suction port 18*a* provided on rear housing 101. FIG. 1 depicts second spiral element 20*b* being located at a position nearest suction port 18*a* such that suction port 18*a* is closed substantially by second spiral element 20*b* during the orbital movement of second scroll member 20. Thus, only a small gap may be formed between the inner surface of rear housing 101 and the outer peripheral surface of second spiral element 20*b*.

In this embodiment, a first groove 101*g* is defined on the inner surface of rear housing 101. First groove 101*g* extends in the circumferential direction over the entire circumference of the inner surface of rear housing 101. Further, a second groove 20*g* is defined on the outer peripheral surface of second spiral element 20*b* of second scroll member 20. Second groove 20*g* extends in the circumferential direction of the outer peripheral surface of second spiral element 20*b*. First and second grooves 101*g* and 20*g* are formed from the inner surface of rear housing 101 and the outer peripheral surface of second spiral element 20*b*, respectively. First and second grooves 101gand 20*g* form oil path 2 that extends in a circumferential direction within housing 10. Oil path 2 forms an oil introduction route including the opening of suction port 18*a* that may introduce oil into suction chamber 18 through suction port 18*a* after compressor 1 is assembled.

Oil introduced through suction port 18*a* may flow into suction chamber 18*a* along oil path 2. When second scroll member 20 is located such that the outer peripheral surface of second spiral element 20*b* is near suction port 18*a*, oil may be introduced into suction chamber 18 through oil path 2 because oil path 2 is defined so that oil path 2 communicates with the opening of suction port 18*a*. Therefore, oil may be introduced regardless of the position of second scroll member 20. Consequently, it is not necessary to adjust the position of second scroll member 20 when oil is introduced, thereby simplifying assembly operations. Moreover, because oil may be introduced smoothly into suction chamber 18 through suction port 18*a* and along oil path 2, the overflow of the oil to the outside of housing 10 may be prevented, even at an increased flow rate for the oil introduction. The increased flow rate for the oil introduction may increase the manufacturing productivity of compressor 1.

Although groove 101*g* is defined on the inner surface of rear housing 101 and groove 20*g* is defined on the outer peripheral surface of second spiral element 20*b*, only one of these grooves may be defined on either the inner surface of rear housing 101 or the outer peripheral surface of second spiral element 20*b*. Further, first spiral element 16*b* may include a groove substantially similar groove 20*g*.

Figure 2:
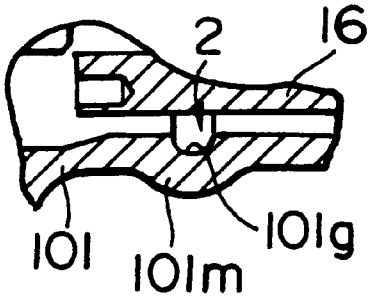
FIG. 2 is a partial, sectional view of a scroll-type compressor according to another embodiment of the present invention.

FIG. 2 depicts a groove forming portion of a scroll-type compressor according to another embodiment of the present invention. A padding portion 101*m* is formed on the outer surface of rear housing 101 at a position corresponding to groove 101*g*. Padding portion 101*m* may be formed by the same material as that of rear housing 101. In such a structure, a thin portion of rear housing 101 formed by defining groove 101*a* is recovered in thickness by padding portion 101*m*. Consequently, even if groove 101*g* is defined on the inner surface of rear housing 101, the groove portion may be sufficiently reinforced, and the local strength of the groove portion may be increased.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A scroll-type compressor including a housing having therein a suction chamber and a discharge chamber, a suction port provided on a wall of said housing and opening to said suction chamber, a first scroll member disposed within said housing and having a first end plate from which a first spiral element axially extends into an interior of said housing, a second scroll member disposed for nonrotatable, orbital movement relative to said first scroll member within the interior of said housing and having a second end plate from which a second spiral element axially extends into the interior of said housing, said first and second spiral elements interfitting at an angular and radial offset to make a plurality of line contacts which define at least one pair of sealed off fluid pockets, and a drive mechanism operatively connected to at least one of said first and second scroll members to effect relative orbital movement between said first and second scroll members and said line contacts, whereby said fluid pockets move inwardly and change in volume such that a fluid is sucked from said suction chamber to said fluid pockets and a compressed fluid is discharged from said fluid pockets to said discharge chamber, said scroll-type compressor comprising:

a groove formed on an inner surface of said housing, said groove extending in a circumferential direction of said housing at a position intersecting with said suction port to form an oil path for introducing oil into the interior of said housing.

2. The scroll-type compressor of claim 1, wherein said groove extends along the circumference of said housing.

3. The scroll-type compressor of claim 1, wherein a padding portion is formed on an outer surface of said housing at a position corresponding to said groove.

4. A scroll-type compressor including a housing having therein a suction chamber and a discharge chamber, a suction port provided on a wall of said housing and opening to said suction chamber, a first scroll member disposed within said housing and having a first end plate from which a first spiral element axially extends into an interior of said housing, a second scroll member disposed for nonrotatable, orbital movement relative to said first scroll member within the interior of said housing and having a second end plate from which a second spiral element axially extends into the interior of said housing, said first and second spiral elements interfitting at an angular and radial offset to make a plurality of line contacts which define at least one pair of sealed off fluid pockets, and a drive mechanism operatively connected to at least one of said first and second scroll members to effect relative orbital movement between said first and second scroll members and said line contacts, whereby said fluid pockets move inwardly and change in volume such that a fluid is sucked from said suction chamber to said fluid pockets and a compressed fluid is discharged from said fluid pockets to said discharge chamber, said scroll-type compressor comprising:

a groove formed on an inner surface of said housing, said groove extending in a circumferential direction of said housing at a position intersecting with said suction port to form an oil path for introducing oil into the interior of said housing.

5. The scroll-type compressor of claim 4, wherein said groove extends along the circumference of said housing.

6. The scroll-type compressor of claim 4, wherein a padding portion is formed on an outer surface of said housing at a position corresponding to said groove.

* * * * *